US008857866B2

(12) United States Patent
Savant

(10) Patent No.: US 8,857,866 B2
(45) Date of Patent: Oct. 14, 2014

(54) HANDLE WITH SAFETY DEVICE FOR VEHICLES

(75) Inventor: Fiorenzo Savant, Santena (IT)

(73) Assignee: VALEO S.p.A., Santena (TO) (IT)

( * ) Notice: Subject to any disclaimer, the term of this patent is extended or adjusted under 35 U.S.C. 154(b) by 833 days.

(21) Appl. No.: 13/000,450

(22) PCT Filed: Jul. 2, 2009

(86) PCT No.: PCT/EP2009/058365

§ 371 (c)(1),
(2), (4) Date: Mar. 16, 2011

(87) PCT Pub. No.: WO2010/003881

PCT Pub. Date: Jan. 14, 2010

(65) Prior Publication Data

US 2011/0156412 A1 Jun. 30, 2011

(30) Foreign Application Priority Data

Jul. 7, 2008 (IT) ..... MI08A1235

(51) Int. Cl.
*E05C 3/00* (2006.01)
*E05B 77/06* (2014.01)
*E05B 77/42* (2014.01)

(52) U.S. Cl.
CPC ..... *E05B 77/06* (2013.01); *E05B 77/42* (2013.01); *Y10S 292/22* (2013.01)
USPC ..... 292/336.3; 292/DIG. 22

(58) Field of Classification Search
USPC ..... 292/336.3, DIG. 22
See application file for complete search history.

(56) References Cited

U.S. PATENT DOCUMENTS

| | | | | |
|---|---|---|---|---|
| 7,070,216 | B2 * | 7/2006 | von zur Muehlen | 292/336.3 |
| 2006/0163887 | A1 | 7/2006 | Savant | |
| 2007/0024068 | A1 * | 2/2007 | Wood | 292/336.3 |
| 2008/0036219 | A1 | 2/2008 | Savant et al. | |
| 2008/0136199 | A1 | 6/2008 | Kim | |

FOREIGN PATENT DOCUMENTS

| | | | |
|---|---|---|---|
| WO | 2004/042177 | A1 | 5/2004 |
| WO | 2006/003197 | A1 | 1/2006 |
| WO | 2008/068262 | A1 | 6/2008 |

OTHER PUBLICATIONS

International Search Report issued in PCT/EP2009/058365, mailed on Sep. 8, 2009, 2 pages.

* cited by examiner

*Primary Examiner* — Mark Williams
(74) *Attorney, Agent, or Firm* — Osha Liang LLP

(57) ABSTRACT

Handle for vehicles, which comprises a first rocker (1) which can rotate with respect to a frame (2) which rotatably supports a lever mechanically connected to the first rocker (1), so that the latter can rotate around a first axis (3; 22) when the lever is driven, wherein a pendulum (6) provided with an inertial mass (8) is pivoted to the frame (2) or to a body integral therewith for oscillating around a second axis (7), said first rocker (1) being provided with a shoulder (9) suitable for being intercepted by a stop member (12) for preventing at least partially the rotation of the first rocker (1), wherein a second rocker (10) provided with the stop member (12) is mechanically connected to the pendulum (6) for oscillating around a third axis (11) when the pendulum (6) oscillates around the second axis (7).

17 Claims, 5 Drawing Sheets

HANDLE WITH SAFETY DEVICE FOR VEHICLES

The present invention relates to a handle with safety device for vehicles, in particular a handle with a lever which can be used for unlocking and simultaneously opening the door of a motor vehicle and is provided with an inertial safety device which prevents the accidental opening of this door in case of an accident.

WO 2004/042177 discloses a vehicle handle, which comprises a rocker which can rotate with respect to a frame which rotatably supports a lever mechanically connected to the rocker, so that the latter can rotate when the lever is driven, wherein a pendulum provided with an inertial mass is pivoted to the frame for oscillating in case of strong accelerations, for example due to an impact. The rocker is provided with a shoulder suitable for being intercepted by a stop member integral with the pendulum for preventing the rotation of the rocker, the operation of the handle and thus the accidental opening of the door.

However, during an impact, the direction of said accelerations is not constant but may oscillate with a waveform evolution, for example sinusoidal, so that the stop member of the pendulum may move away from the shoulder, so as to unlock the lever of the handle before the impact has ended.

It is therefore an object of the present invention to provide a handle, which is free from said disadvantage, namely a handle wherein the rocker can be locked when the pendulum oscillates in both directions due to strong accelerations. Said object is achieved with a handle, whose main features are disclosed in the first claim, while other features are disclosed in the remaining claims.

Thanks to its particular second rocker, which releases the movement of the pendulum from the one of the stop member, the first rocker of the handle according to the present invention can be locked when the pendulum oscillates in one direction and in the opposite direction.

Thanks to the particular mutual arrangement, relative dimensions and mechanical connection of the parts of the pendulum and of the second rocker, the handle according to the present invention is more compact and lighter than the known handles and further it allows faster reaction times.

The first rocker is preferably provided with a cam surface on which a tappet of the pendulum can slide for driving the pendulum and the second rocker during the normal use, so as to prevent their malfunctions, due to the prolonged inactivity, in case of impact.

Further advantages and features of the handle according to the present invention will become clear to those skilled in the art from the following detailed and non-limiting description of two embodiments thereof with reference to the attached drawings, wherein.

Figure 1:
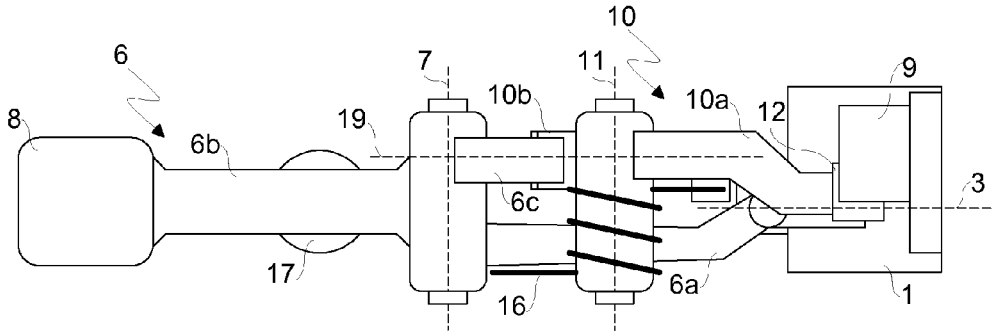
FIG. 1 shows a partial side view of the first embodiment of the handle in a rest position.
Figure 2:
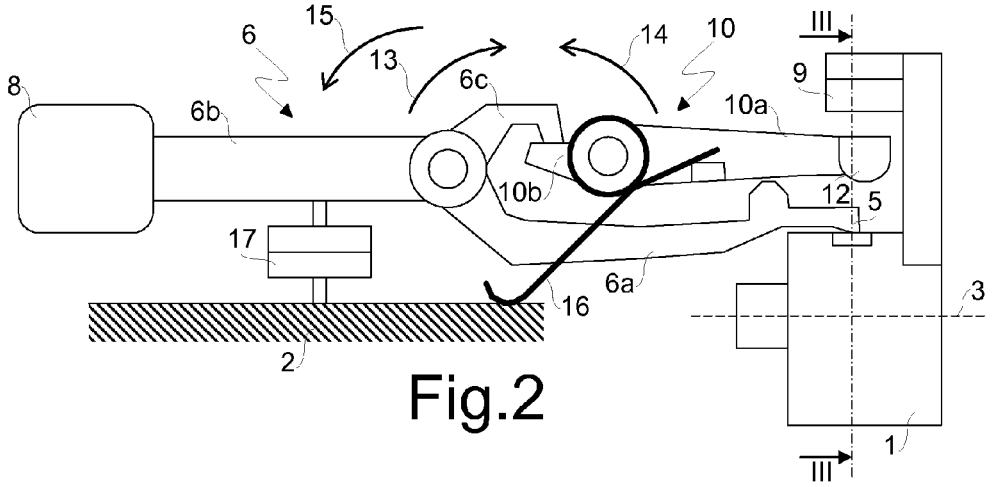
FIG. 2 shows a partial top view of the handle of FIG. 1.
Figure 3:
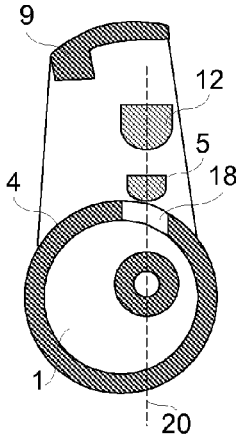
FIG. 3 shows section III-III of FIG. 2.

Referring to FIGS. 1 to 3, it is seen that the handle according to the first embodiment of the present invention comprises in a known way a first rocker 1 which can rotate with respect to a frame 2 which rotatably supports a lever (not shown in the figures) which can be pulled for unlocking and simultaneously opening the door of a motor vehicle. Said lever is mechanically connected to the first rocker 1, so that the latter can rotate around a first axis 3 when the lever is driven. First rocker 1 is in turn connected to the unlocking mechanism of the door, so that the latter can be opened by further pulling the lever. Said connection is for example carried out by means of a cable which is pulled by first rocker 1 during its rotation.

First rocker 1 is provided with a cam surface 4 on which a tappet 5 arranged on a first arm 6*a* of a pendulum 6 pivoted to frame 2 or to a body integral therewith can slide for oscillating around a second axis 7 substantially perpendicular to first axis 3 around which first rocker 1 rotates. A second arm 6*b* of pendulum 6 opposite to first arm 6*a* with respect to second axis 7 is provided with an inertial mass 8. First rocker 1 is provided with a shoulder 9 arranged at a distance from cam surface 4 higher than the height of tappet 5 of pendulum 6. Tappet 5 passes then under shoulder 9 without touching it if it slides on cam surface 4.

According to the invention, a second rocker 10 is mechanically connected to pendulum 6 for oscillating around a third axis 11 substantially parallel to second rotation axis 7 of pendulum 6 when the latter oscillates around second axis 7. Second rocker 10 comprises an arm 10*a* provided with a stop member 12 suitable for intercepting shoulder 9 during an oscillation of second rocker 10 for preventing at least partially the rotation of first rocker 1. Second rocker 10 further comprises a tongue 10*b* arranged on the side opposite to aim 10*a* with respect to third axis 11. Pendulum 6 is provided with a tongue 6*c* arranged on the same side of first arm 6*a* with respect to second axis 7. The mechanical connection between pendulum 6 and second rocker 10 is obtained by means of the engagement, in particular the contact, of tongue 6*c* of pendulum 6 with tongue 10*b* of second rocker 10. Through this first mechanical connection, the rotation of pendulum 6 in one direction 13, for example clockwise as in FIG. 2, causes the rotation of second rocker 10 in the opposite direction 14, for example counterclockwise.

A second mechanical connection between pendulum 6 and second rocker 10 is obtained by means of the engagement, in particular the contact, of first arm 6*a* of pendulum 6 with arm 10*a* of second rocker 10. Through this second mechanical connection, the rotation of pendulum 6 in one direction 15, for example counterclockwise as in FIG. 2, causes the rotation of second rocker 10 in the same direction 14, for example counterclockwise. Therefore, second rocker 10 is mechanically connected to pendulum 6 so as to rotate in one direction 14 only in which stop member 12 moves toward shoulder 9 when pendulum 6 rotates in this same direction 15 or in the opposite direction 13 due to accelerations acting on inertial mass 8. Elastic means 16, in particular a helical spring arranged around third axis 11, urge second rocker 10 in the direction opposite to direction 14, so as to move stop member 12 away from shoulder 9.

A hydraulic, pneumatic or electric damper 17 which is arranged between frame 2 and pendulum 6 dampens the oscillations of the latter. Cam surface 4 of first rocker 1 is further provided with a hollow 18 suitable for housing at least partially tappet 5 for allowing its free movement. Tongue 6*c* of pendulum 6, arm 10*a* and tongue 101) of second rocker 10 are arranged along a fourth axis 19 substantially perpendicular to second axis 7 and/or to third axis 11. Tappet 5 and stop member 12 are arranged along a fifth axis 20 substantially perpendicular to first axis 3.

Figure 4:
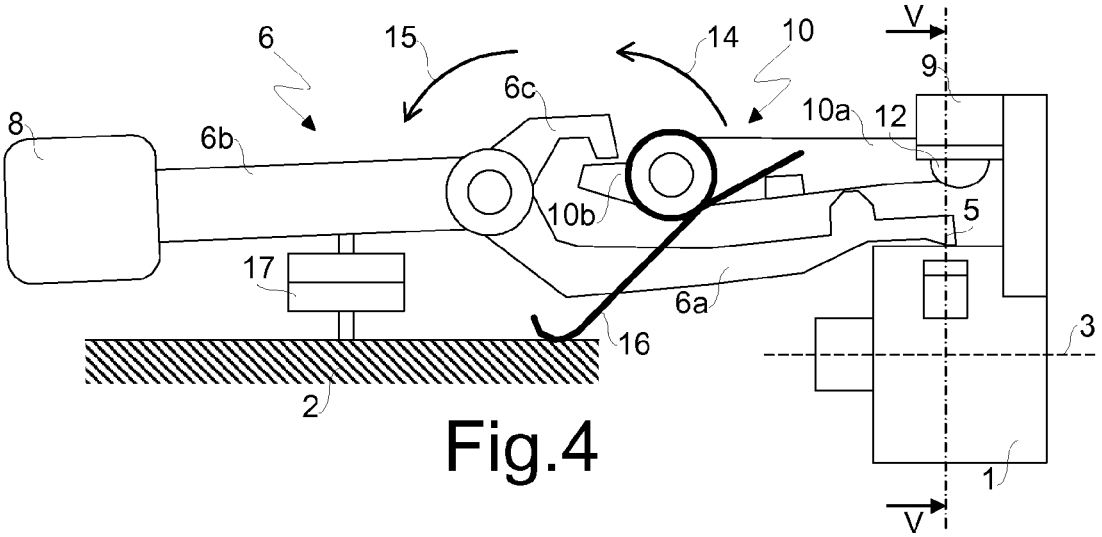
FIG. 4 shows a partial top view of the handle of FIG. 1 in a normal use position.
Figure 5:
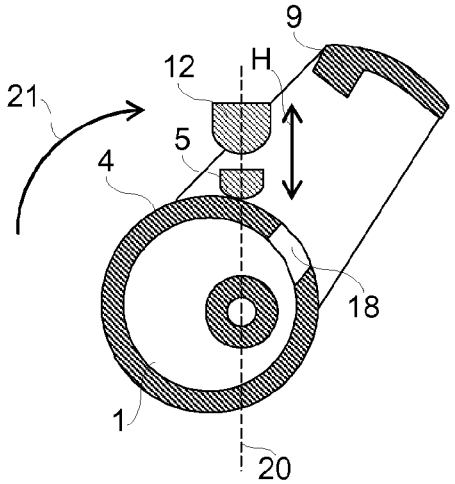
FIG. 5 shows section V-V of FIG. 4.

Referring to FIGS. 4 and 5, it is seen that when the handle according to the present invention is used normally, namely when its lever is pulled by a user for opening the door of a vehicle, first rocker 1 rotates around first axis 3 in direction 21, for example clockwise as in FIG. 5, so that tappet 5 slides on cam surface 4 of first rocker 1, thereby slightly rotating pendulum 6 in direction 15 and consequently second rocker 10 in direction 14, through the mechanical connection between first arm 6*a* of pendulum 6 and arm 10*a* of second rocker 10. During the rotation of first rocker 1 around first axis 3, space H occupied in height by tappet 5 and stop member 12 is shorter than the distance between cam surface 4 and shoulder 9 of first rocker 1, so that stop member 12 cannot intercept shoulder 9. When the lever of the handle is not pulled anymore, elastic means rotate first rocker 1 in the direction opposite to direction 21.

Figure 6:
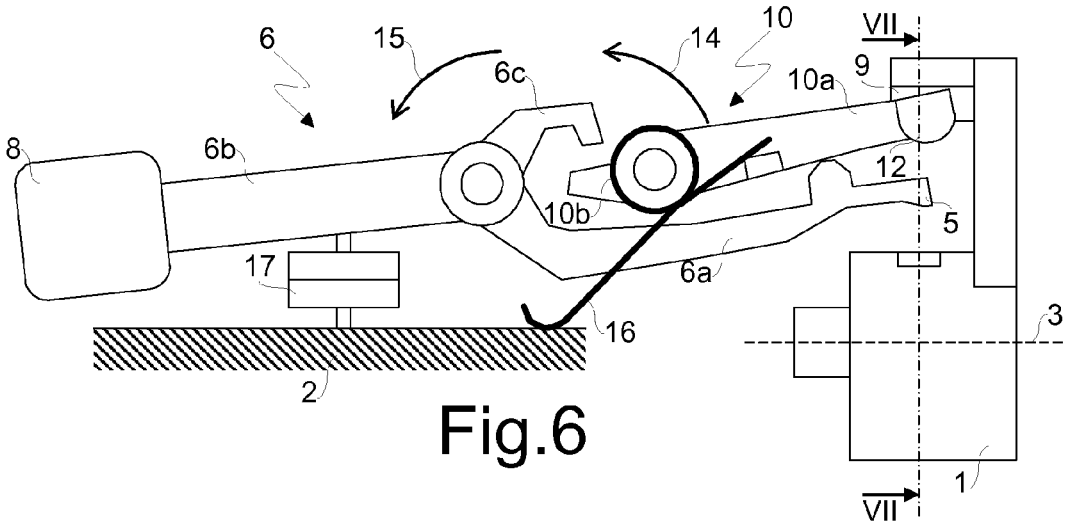
FIG. 6 shows a partial top view of the handle of FIG. 1 in a first impact position.
Figure 7:
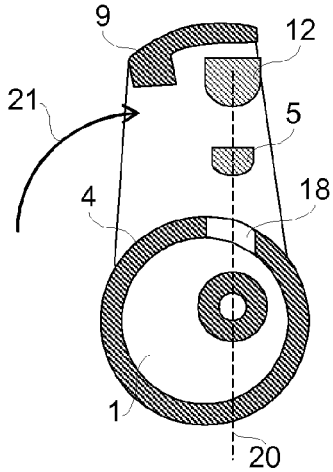
FIG. 7 shows section VII-VII of FIG. 6.

Referring to FIGS. 6 and 7, it is seen that when the handle according to the present invention undergoes an acceleration in a first direction, for example due to an impact, inertial mass 8 rotates pendulum 6 in direction 15, so as to cause a rotation of second rocker 10 in the same direction 14, through the mechanical connection between first arm 6*a* of pendulum 6 and arm 10*a* of second rocker 10. During this oscillation, tappet 5 moves away from cam surface 4 of first rocker 1 along fifth axis 20, stop member 12 moves in the same direction of tappet 5 along fifth axis 20 and can intercept shoulder 9 of first rocker 1, so as to prevent at least partially a rotation thereof in direction 21, namely for locking first rocker 1 or allowing only a minimum rotation thereof in direction 21.

Figure 8:
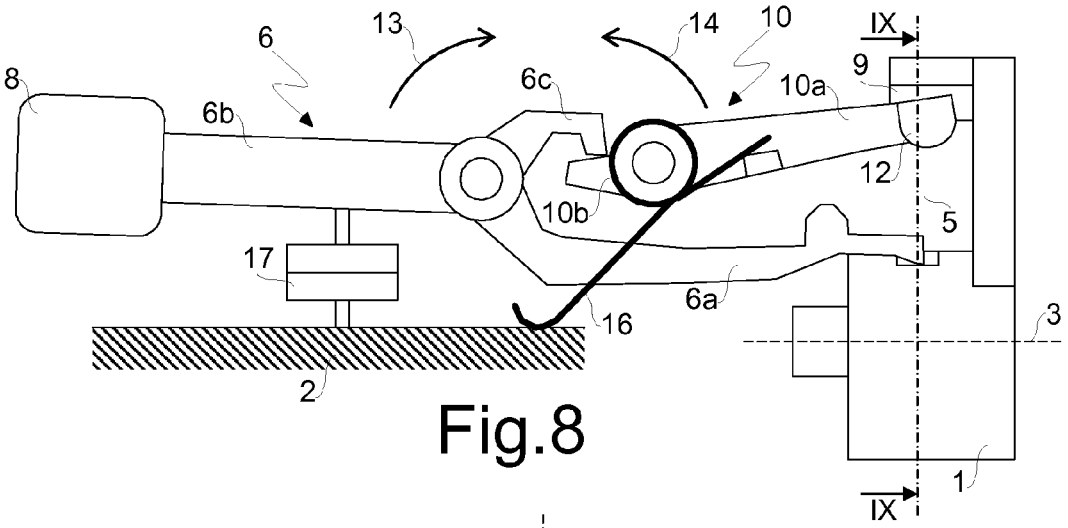
FIG. 8 shows a partial top view of the handle of FIG. 1 in a second impact position.
Figure 9:
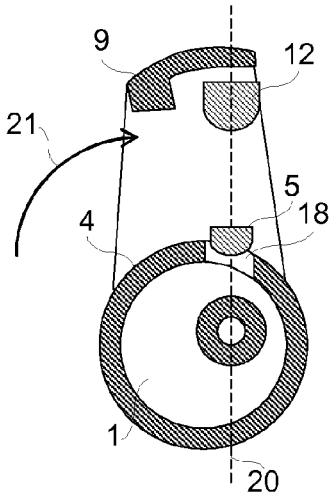
FIG. 9 shows section IX-IX of FIG. 8.

Referring to FIGS. 8 and 9, it is seen that when the handle according to the present invention undergoes an acceleration in a second direction, for example due to an impact, opposite to said first direction, inertial mass 8 rotates pendulum 6 in direction 13, so as to cause a rotation of second rocker 10 in the opposite direction 14, through the mechanical connection between tongue 6*c* of pendulum 6 and tongue 10*b* of second rocker 10. During this oscillation, tappet 5 moves close to cam surface 4 of first rocker 1 along fifth axis 20, so as to be housed at least partially in hollow 18, while stop member 12 moves in the opposite direction of tappet 5 along fifth axis 20 and can intercept shoulder 9 of first rocker 1, so as to prevent at least partially a rotation thereof in direction 21.

Figure 10:
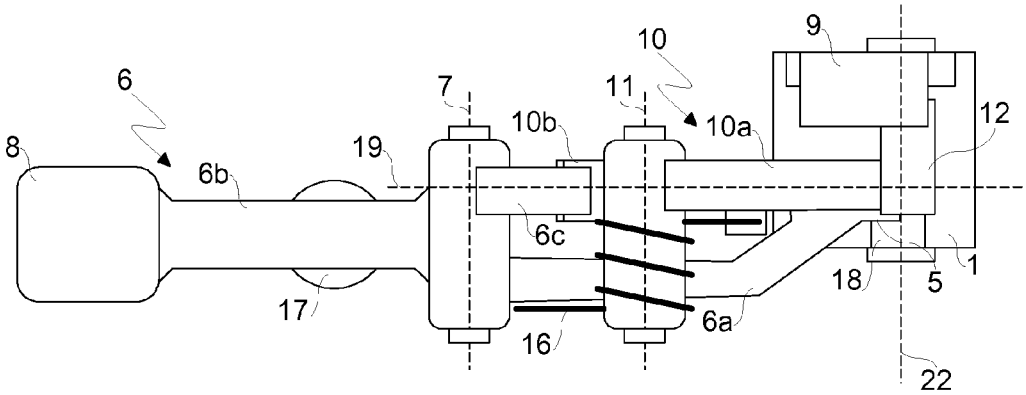
FIG. 10 shows a partial side view of the second embodiment of the handle in a rest position.
Figure 11:
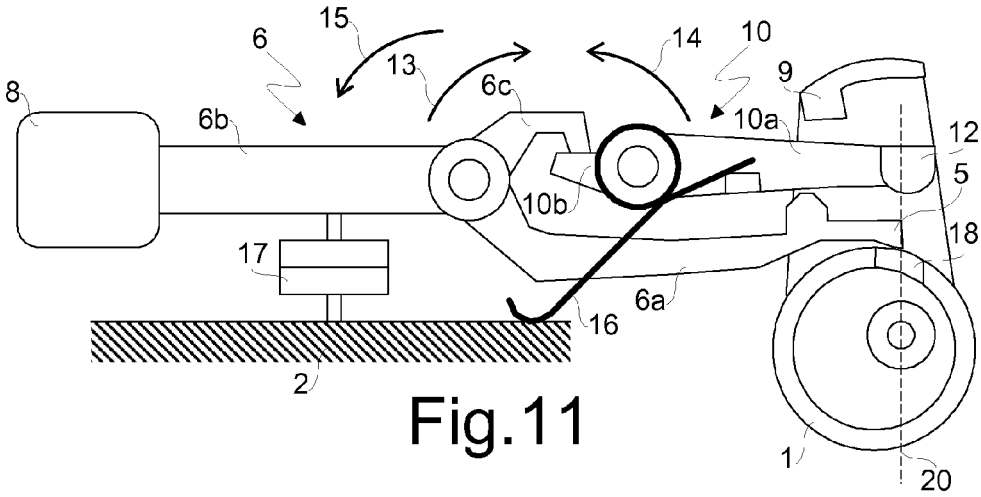
FIG. 11 shows a partial top view of the handle of FIG. 10.

Referring to FIGS. 10 and 11, it is seen that the second embodiment of the handle is substantially the same as the first embodiment, however first rocker 1 can rotate around a first axis 22 substantially parallel to second axis 7 of pendulum 6 and to third axis 11 of second rocker 10. Stop member 12 projects transversely, in particular along an axis substantially parallel to third axis 11, with respect to arm 10*a* of second rocker 10, so as to intercept shoulder 9, which is arranged beside arm 10*a* of second rocker 10.

Further modifications and/or additions may be made by those skilled in the art to the hereinabove disclosed and illustrated embodiments while remaining within the scope of the following claims.

The invention claimed is:

1. A handle for vehicles, comprising:

a first rocker which can rotate with respect to a frame, wherein the frame rotatably supports a lever mechanically connected to the first rocker, so that the latter can rotate around a first axis when the lever is driven, wherein a pendulum provided with an inertial mass is pivoted to the frame or to a body integral therewith for oscillating around a second axis, wherein said first rocker is provided with a shoulder suitable for being intercepted by a stop member for preventing at least partially the rotation of the first rocker; and a second rocker provided with the stop member that is mechanically connected to the pendulum for oscillating around a third axis when the pendulum oscillates around the second axis, wherein the second rocker is mechanically connected to the pendulum so as to rotate in a direction in which the stop member moves toward the shoulder independent of the direction of rotation of the pendulum.

2. The handle according to claim 1, wherein the third axis is substantially parallel to the second axis.

3. The handle according to claim 1, wherein the first rocker is provided with a cam surface on which a tappet of the pendulum can slide for oscillating the pendulum around the second axis.

4. The handle according to claim 3, wherein the cam surface of the first rocker is provided with a hollow suitable for housing at least partially the tappet.

5. The handle according to claim 3, wherein the mechanical connection between the pendulum and the second rocker is obtained by means of the engagement of a tongue of the pendulum with a tongue of the second rocker.

6. The handle according to the previous claim 5, wherein through said mechanical connection, the rotation of the pendulum in a direction causes the rotation of the second rocker in an opposite direction.

7. The handle according to claim 5, wherein the mechanical connection between the pendulum and the second rocker is obtained by means of the engagement of a first arm of the pendulum with an aim of the second rocker.

8. The handle according to claim 5, wherein through said mechanical connection, the rotation of the pendulum in a direction causes the rotation of the second rocker in the same direction.

9. The handle according to claim 7, wherein the tappet is arranged on the first aim of the pendulum, while the inertial mass is arranged on a second arm of the pendulum opposite to the first arm with respect to the second axis.

10. The handle according to claim 7, wherein the tongue of the pendulum is arranged on a same side of the first arm of the pendulum with respect to the second axis.

11. The handle according to claim 7, wherein the arm of the second rocker is provided with the stop member.

12. The handle according to claim 7, wherein the tongue of the second rocker is arranged on the side opposite to the arm of the second rocker with respect to the third axis.

13. The handle according to claim 7, wherein the tongue of the pendulum, and the arm and the tongue of the second rocker are arranged along an axis substantially perpendicular to the second axis or the third axis.

14. The handle according to claim 1, wherein the tappet and the stop member are arranged along an axis substantially perpendicular to the first axis.

15. The handle according to claim 1, wherein elastic means urge the second rocker so as to move the stop member away from the shoulder.

16. The handle according to claim 1, wherein a damper arranged between the frame and the pendulum dampens the oscillations of the pendulum.

17. The handle according to claim 1, wherein the first axis is substantially perpendicular to the second axis.

* * * * *